US005846121A

United States Patent [19]

Hayashi et al.

[11] Patent Number: 5,846,121

[45] Date of Patent: Dec. 8, 1998

[54] METHOD FOR MACHINING A WORKPIECE BY RENEWING A TOOL MOVABLE RANGE

[75] Inventors: Yutaka Hayashi, Chiryu; Makoto Nonoyama; Tomonari Kato, both of Kariya; Toshihiro Yonezu, Nishio; Nobuo Ohkubo, Ohtsu, all of Japan

[73] Assignee: Toyoda Koki Kabushiki Kaisha, Kariya, Japan

[21] Appl. No.: 854,751

[22] Filed: May 12, 1997

Related U.S. Application Data

[63] Continuation of Ser. No. 508,108, Jul. 28, 1995, abandoned.

[30] Foreign Application Priority Data

Jul. 29, 1994 [JP] Japan ..... 6-178849

[51] Int. Cl.[6] ..... B24B 49/00

[52] U.S. Cl. ..... 451/8; 451/9; 451/11; 451/51

[58] Field of Search ..... 451/8, 9, 10, 11, 451/407, 408, 51

[56] References Cited

U.S. PATENT DOCUMENTS

| | | | |
|---|---|---|---|
| 4,481,568 | 11/1984 | Inaba et al. . | |
| 4,604,705 | 8/1986 | Imanishi . | |
| 4,758,961 | 7/1988 | Uemura et al. . | |
| 5,562,523 | 10/1996 | Asano et al. | 451/11 |

*Primary Examiner*—Eileen P. Morgan
*Attorney, Agent, or Firm*—Oblon, Spivak, McClelland, Maier & Neustadt, P.C.

[57] ABSTRACT

A machining apparatus for machining a workpiece by moving a tool in direction relative to the workpiece comprises, tool moving means for moving the tool in the direction relative to the workpiece, tool movable range setting means for setting a movable range for the tool to inhibit the workplace from exceeding a reference size by inputting the reference size, and halting means for halting a movement of the tool when a position of said tool exceeds the tool movable range set by said tool movable range setting means.

7 Claims, 7 Drawing Sheets

METHOD FOR MACHINING A WORKPIECE BY RENEWING A TOOL MOVABLE RANGE

This application is a continuation of application Ser. No. 08/509,108, filed on Jul. 28, 1995, now abandoned.

BACKGROUND OF THE INVENTION

1. Field of the Invention

The present invention relates to a machining method which makes operation by an operator easier by establishing and/or renewing a tool movable range which signifies an allowable range of movement or restricts an amount of movement of a tool. More particularly, the invention relates to an optimal method for grinding a workpiece, without requiring excessive manual feeding or movement.

2. Discussion of the Prior Art

In the prior art, when an operator performs a manual grinding for infolding a wheel head whereby a workpiece is ground toward its radius direction, there are primarily considered two procedures in the grinding operation as follows;

In one of the two procedures wherein an extremely high machining accuracy is required, after a workpiece "W" shown in FIG. 2(*a*) is ground until a radius amount of the workpiece "W" coincides with a dimensional amount in which an oversized amount "d" are added to a finish radius "D" thereof on the basis of numerically controlled (hereinafter called the NC) data, the manual infeed operation is performed instead of an automatic grinding operation. In this manner, the automatic grinding operation is completed as soon as the radius of the workpiece reaches a dimensional amount in which the oversized amount "d" remains as excess, and then the radius amount of the workpiece "W" is measured. On the basis of the result of the measurement, the operator can have knowledge as to how much of the workpiece is to be ground to obtain the finished radius. As a result, the operator performs the manual infeed operation to grind the remainder of the workpiece while reading a coordinate value displayed on a control panel or a value of a scale equipped on a handle. A method is also known in which the entire amount of the remainder in ground automatically rather than by a manual infeed operation. However, a sufficiently high machining accuracy can not be obtained by grinding the remainder automatically as in the aforementioned method because of a thermal deformation, variations of cutting quality, accuracy of the grinding wheel, and so forth. Eventually even an expert operator must modify a finished surface of the workpiece by a manual infeed operation in order to maintain the desired high machining accuracy, while keeping the machining operation in view in order to avoid grinding failure. Therefore, the fact of the matter is that sufficiently high machining accuracy is maintained by only expert experience relating to the aforementioned manual infeed operation.

In another case wherein an un-machined surface of the workpiece is ground by a manual infeed operation which is performed manually by rotating a handle for infeeding a wheel head without using NC data. In general after a green face (that is the un-machined surface of the workpiece "W" before an initial machining is done) is completely removed by grinding until the workpiece is available for a measurement of the radius amount of the workpiece, the radius of the ground workpiece is measured by a measuring device. On the basis of the result of this measurement, the wheel head is infed toward the radius direction of the workpiece manually to remove the entire amount of the difference between a current measured radius and a desired radius (such as a finish radius of the workpiece). At this time, the operator confirms whether the workpiece has been ground up to the desired dimensional radius while reading the coordinate value displayed on the control panel or the value of the scale equipped on the handle to avoid an excess grinding failure.

Accordingly, in either of the two procedures as described above, a manual infeed operation is required to obtain a desired precise dimension. However, sufficiently high accuracy is not obtained, since the operator performs the manual infeed operation while reading the coordinate value displayed on the control panel or the value of the scale equipped on the handle. Namely, while confirming the sparking condition on the ground workpiece during the grinding operation, the operator must consider how an infeed rate of the wheel head influences a finish aspect of the workpiece, so that variation in the finish aspect can arise from the infeed rate during the manual infeed operation. Owing to such a complication, the operator must perform the grinding operation while not merely keeping the ground workpiece in view but also reading either the value of the scale equipped on the handle or the coordinate value displayed on the control panel. Therefore, it is very difficult to perform the manual infeed operation without a grinding failure. As a result, an unskilled operator is apt to perform an excess grinding operation mistakenly, which causes a deformity or imperfection on the workpiece, and in addition, it takes considerable time to accomplish the grinding finish with sufficiently high machining accuracy.

SUMMARY OF THE INVENTION

Accordingly, it is an object of the present invention to provide an improved machining method which offers highly precise and short-time machining by a manual infeed operation without requiring expert experience.

Another object of the present invention is to provide a high efficiency grinding operation which does not bring about excess manual infeed causing a deformity or a defect on the workpiece.

Briefly, the present invention provides a method for machining a workpiece by moving a tool in a direction relative to the workpiece comprising moving the tool in the direction relative to the workpiece, inputting a reference size of the workpiece, utilizing a tool movable range setting means for setting a movable range for the tool moved by a tool moving means according to a reference, size input means to inhibit the workpiece from being machined beyond a reference size, and halting movement of the tool when a position of the tool exceeds the tool movable range set by the tool movable range setting means. Because of the halting step stopping the tool from exceeding the tool movable range, excess grinding failure during the manual operation by the operator can be avoided by the invention.

A machining method for machining a workpiece by moving a tool by a tool moving means in a direction relative to a workpiece comprises, utilizing a reference size input means for inputting a reference size of the workpiece, utilizing a tool movable range setting means for setting a movable range for the tool moved by said tool moving means according to instructions issued from the reference size input means to inhibit the workpiece from being machined beyond the reference size, utilizing an additional machining amount setting means for setting an additional machining amount to move the tool in the direction relative to the workpiece, and utilizing tool movement correct means for correcting the movable range toward the workpiece according to instructions issued from the additional machining amount setting means. The movable range is renewed when the tool is infed by the additional machining amount, and halting means halts movement of the tool when a position of the tool exceeds the tool movable range set by the tool movement correct means. Since the tool movement corrects means correct the tool movable range toward the workpiece, even if there is a difference amount between a current measured radius of the ground workpiece and a desired radius because of a thermal deformation or an axial bend of the workpiece, the operator can easily repeat further manual grinding operations to obtain an extremely high machining accuracy.

The machining method for machining a workpiece by moving a tool by a tool moving means in direction relative to a workpiece further comprises, utilizing a reference size input means for inputting a reference size of the workpiece, utilizing a tool movable range setting means for setting a movable range for the tool moved by the tool moving means according to instructions issued from the reference size input means to inhibit the workpiece from being machined to exceed the reference size, and utilizing an additional machining amount setting meant for setting an additional machining amount of movement of the tool in the direction relative to the workpiece. Tool movement correct means are then utilized for correcting the movable range toward the workpiece according to instructions issued from the additional machining amount setting means, and the movable range is renewed when the tool is infed by the additional machining amount. Instructions are then input manually for the tool to move the tool in a direction relative to the workpiece and halting means halt movement of the tool by the manual input means when a position of the tool exceeds the tool movable range set by the tool movement correct means. Because the movement of the tool is halted by the manual operation of the operator, the operator can perform the manual operation without reading the coordinate value displayed on the control panel nor the value of the scale equipped on the handle. Therefore, the operator can concentrate on sparks and a machining area to adjust an infeed rate of the tool precisely, and it is easy to achieve an extremely high machining accuracy.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiment when considered in connection with the accompanying drawings, in which:

FIG. 1 is a schematic view showing the structure of a numerical control grinding machine according to the present invention;

FIGS. 2 (*a*) and 2 (*b*) are an explanatory diagram showing a grinding operation to explain the first embodiment according to the present invention;

FIGS. 3 (*a*) and 3 (*b*) are an explanatory diagram showing another grinding operation to explain the second embodiment according to the present invention, FIG. 4 is a flow chart of a routine showing a grinding operation executed by a central processing unit in the first embodiment of the present invention;

DETAILED DESCRIPTION OF THE PREFERRED EMBODIMENT

Figure 1:
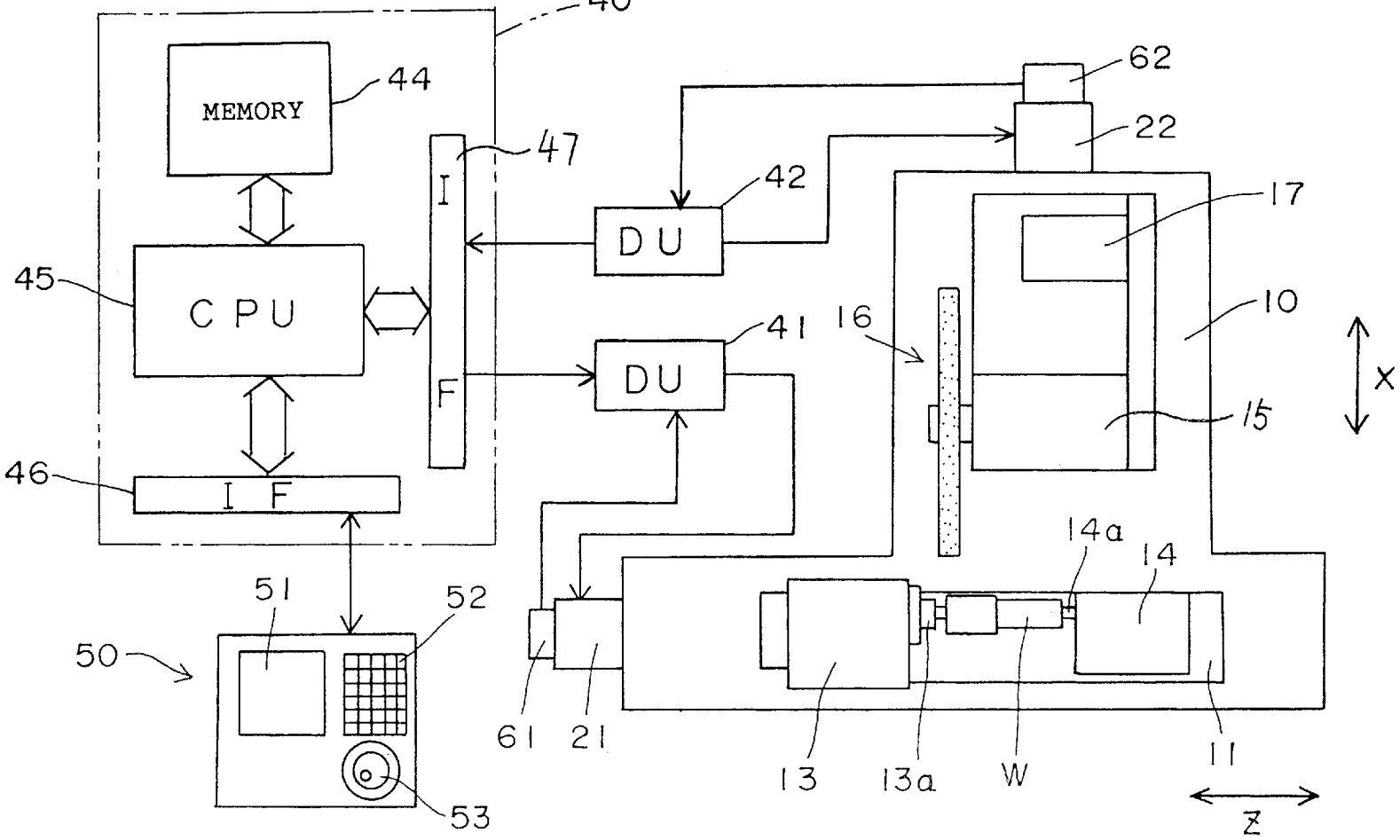

Referring now to the drawings and particularly to FIG. 1, numeral 10 indicates a bed on which a table 11 is guided slidably in a horizontal direction (Z axis). A spindle head 13 is furnished to oppose a tailstock 14 on the table 11. A chuck 13*a* is attached on the spindle head 13 to hold one end of the workplace W, and similarly, a center 14*a* is furnished on the tailstock 14 to hold another end thereof to support the rotational axis of the workpiece W, which is driven rotatably by the spindle head 13. On the bed 10, a wheel head 15 is guided slidably in a horizontal direction (X axis) perpendicular to the direction of table movement. A grinding wheel 16 is supported on the wheel head 15 to be rotatable around an axis parallel to the direction of table movement and is driven rotatably by a driving motor 17 through a belt and a pulley (not shown). The table 11 is driven slidably by a servomotor 21 on the bed 10, and the wheel head 15 is driven slidably by a servomotor 22 thereon. In addition, two encoders 61, 62 are attached to each of the servomotors 21, 22 respectively.

A numerical controller 40 is comprised of a central processing unit (hereinafter called the CPU) 45, a memory 44, and input/output interfaces 46, 47. The interface 46 is connected with various control parameters needed for the numerical control and is connected to a control panel 50 for inputting the NC program. The control panel 50 includes a display device 51, a keyboard 52 with a start button and various buttons for inputting data, a handle 53 for manually infeeding the wheel head 15, and so forth. This handle 53 is connected to a pulse generator inside of the control panel 50 in which pulses are generated in response to the rotational amount of the handle 53. Similarly, the interface 47 is connected to servo motor drive units 41, 42 which are a circuit board for driving the servomotors 21, 22 in accordance with instructions issued from the CPU 45. The current position data relating to both of the table 11 and the wheel head 15 is detected by encoders 61, 62 respectively, and is fed back to the servo motor drive-units 41, 42. The memory 44 provides a parameter area for storing various control parameters inputted through the control panel 50, and on NC program area stores the NC program, and so forth.

In a grinding procedure of the above described apparatus, any embodiment according to the present invention relates to a tool movable range which restricts a movable amount for a tool to avoid an excess manual infeeding during the grinding operation. Then, the tool movable range is repeatedly renewed by adding a grinding amount necessary to grind as an additional grinding amount "T". As a result, the operator preforms the manual indeed operation easily without considering grinding failure.

As to when the aforementioned tool movable range is established or renewed, there are considered two embodiments as described in the Discussion of the Prior Art.

Referring now to the first one of the two aforementioned embodiments, in the case where extremely high machining accuracy is required, after an automatic grinding operation is performed until a radius amount of the workpiece "W" coincides with a dimensional amount in which the oversized amount "d" is added to the finish radius "D" on the basis of the NC program, the operator then performs the manual infeed operation to eliminate the oversized amount "d".

The second embodiment is for the case where it is necessary to remove a green face from an un-machined workpiece, and a manual infeed operation is performed to remove the green face thereof until the workpiece "W" is available for a measurement of a radius of the workpiece. After this measurement, there is further eliminated the dimensional amount of the difference between a current measured radius of the workpiece "W" and a desired radius thereof by performing the manual grinding operation.

Figure 2A:
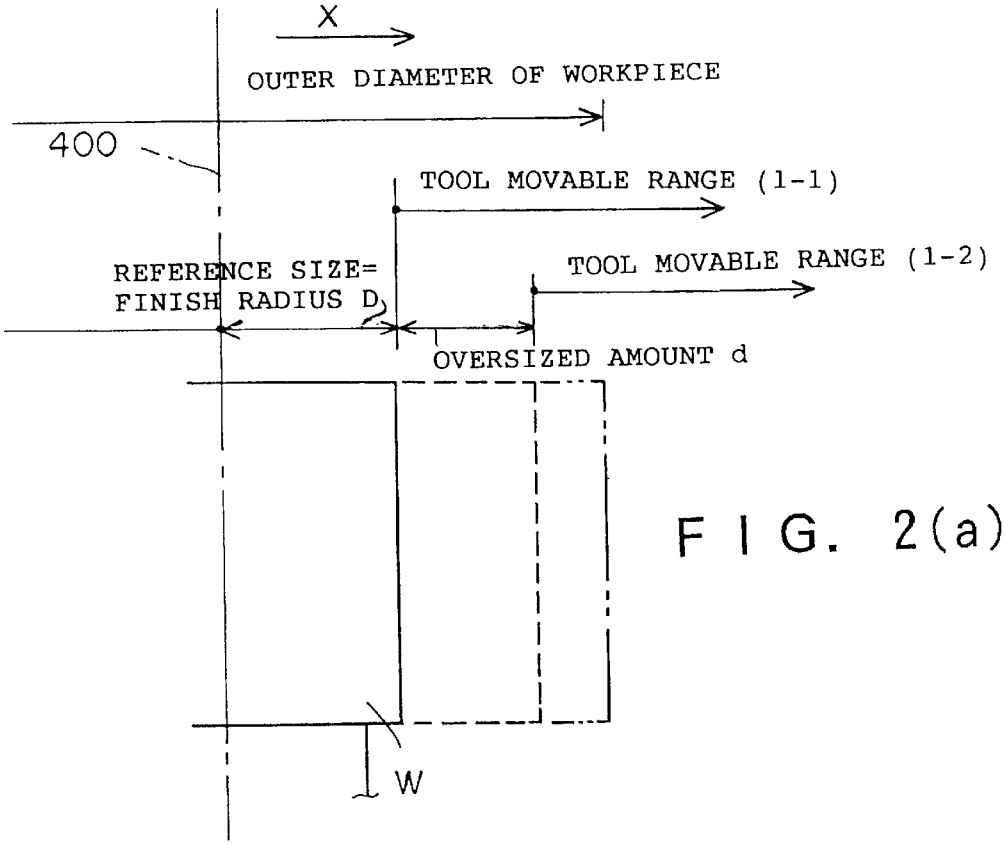
Figure 2B:
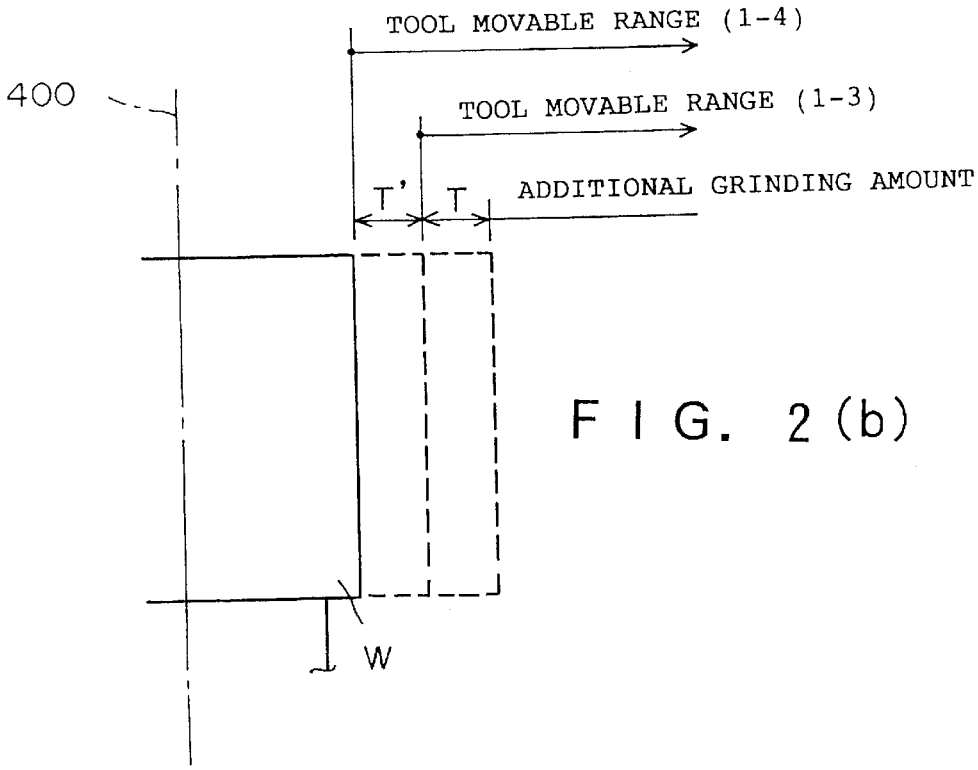
Figure 3A:
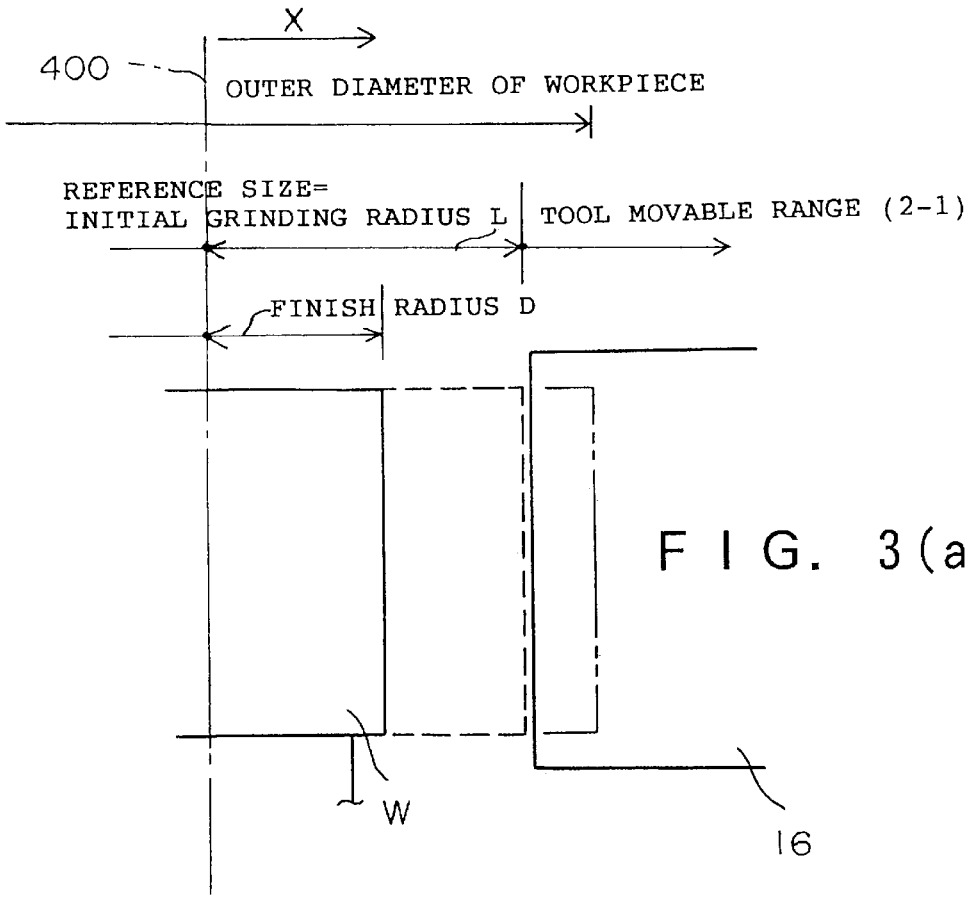
Figure 3B:
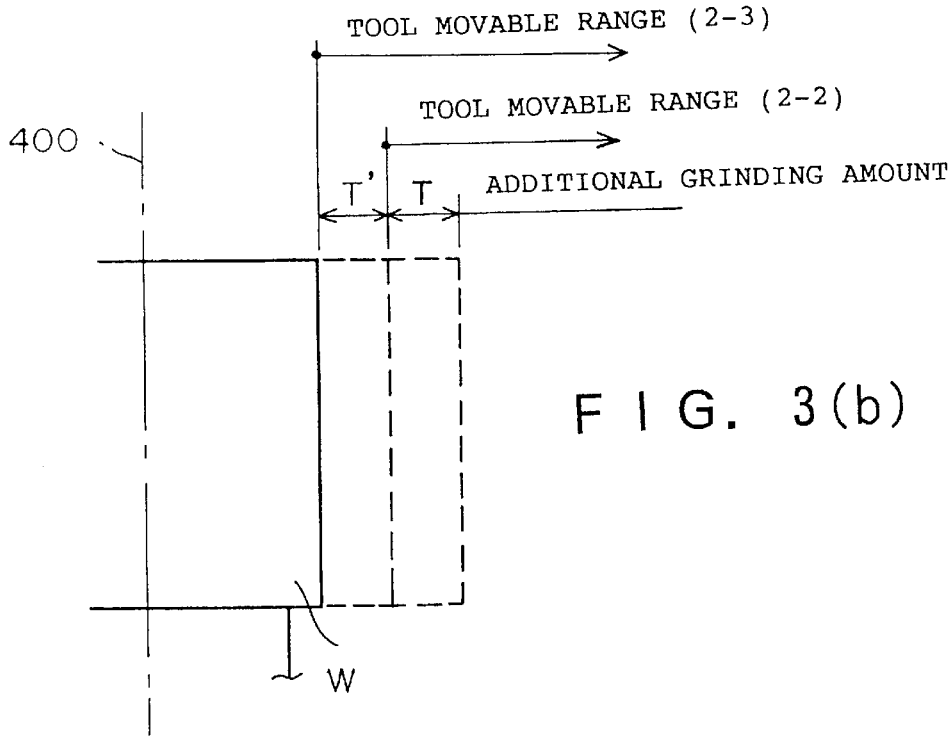

With the operation of the present invention, a reference size, an oversized amount "d", and an additional grinding amount "T" are utilized to establish the tool movable range. The reference size indicates the finish radius "D" as shown in FIG. 2 (*a*) in the first embodiment, and similarly indicates an initial grinding radius "L" as shown in FIG. 3 (*a*) in the second embodiment. Incidentally, dimensions are exaggerated in FIG. 2 and FIG. 3 for ease of reference. The finish radius "D" indicates a dimensional amount on which the workpiece "W" has been completely ground to the desired radius, and the finish radius "D" is set as a dimensional radius amount from the workpiece axis 400. In addition, the dimensional amount of the initial grinding radius "L" as shown in FIG. 3 corresponds to a dimensional amount of the wheel head 15 when the grinding wheel 16 is brought into contact with the surface of the workpiece "W", and is set as a dimensional amount from the workpiece axis 400 to abrasive tips of the grinding wheel 16. Although the aforementioned dimensions are set as coordinates oriented on the basis of the workpiece axis 400, the present invention is not restricted to the coordinates as described above. For example, coordinates may be oriented in a direction toward the workpiece axis. Similarly, other positions may be set as dimensional reference points to calculate distance.

In the case where the additional grinding operation is performed to meet the demand of sufficiently high machining accuracy according to the first embodiment, the oversized amount "d" indicates a dimensional amount from the finish radius "D", and furthermore in defined as a dimensional amount required to be eliminated in the case where the additional grinding is performed to achieve the sufficiently high machining accuracy. When the radius amount of the workpiece "W" coincides with a dimensional amount in which the oversized amount "d" is added to the finish radius "D", the automatical grinding operation is halted and then the radius amount of the workpiece "W" is measured. After this measurement, the additional grinding amount "T" is determined on the basis of the difference between the finish radius "D" and the current measured radius. Then, the manual infeed operation is performed to complete the workpiece to the desired radius. The additional grinding amount "T" is defined as a dimensional amount necessary to be ground from the finish radius "D" plus the oversized amount "d". However, this additional grinding amount "T" is not restricted to the above described case, and furthermore may be applied to the second embodiment as described hereinafter.

The aforementioned tool movable range setting will be explained in more detail hereinafter with respect to the first embodiment and the second embodiment.

Figure 4:
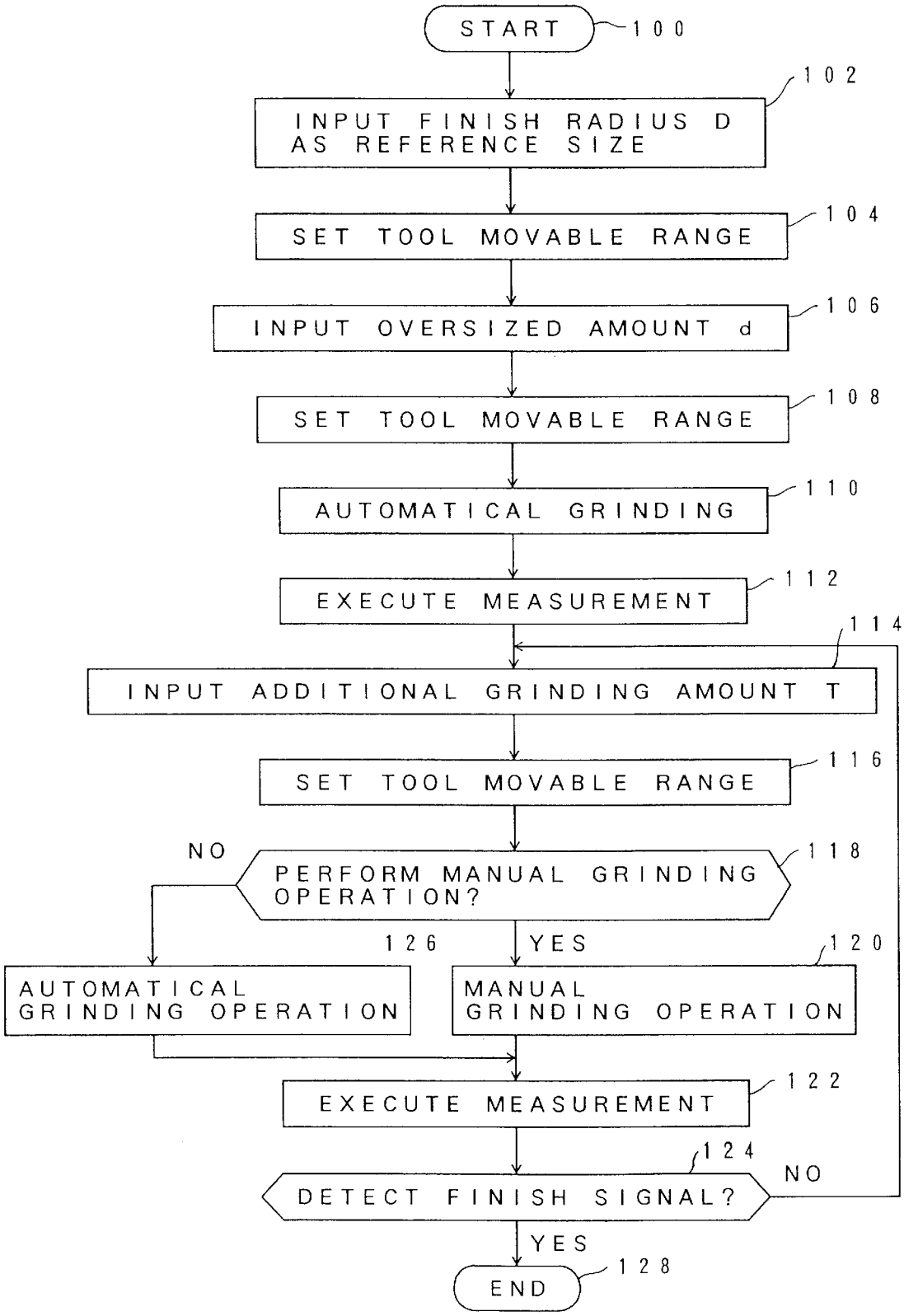

First, the first embodiment will be described hereinafter according to the explanatory diagram of FIG. 2 and the flow chart of FIG. 4. At step 100, a program routine is started relating to the grinding operation as shown in FIG. 4. As a reference size required at step 102, the finish radius "D" instead of the reference size is input by reading it from a NC program stored in a memory beforehand in the above described first embodiment. At step 104, a tool movable range is established by utilizing the finish radius "D" as a boundary which restricts the tool movement. Thus, positioning of the wheel head 15 is controlled by setting a dimensional amount on the basis of abrasive tips of the grinding wheel 16, namely on the basis of a radius dimension of, the grinding wheel 16, so that the tool movable range is established to prohibit the abrasive tips from advancing into the reference size. Therefore, the upper portion above the dimensional amount of the finish radius "D" is defined as the tool movable range (1—1) for restricting the movement of the grinding wheel 15 as shown in FIG. 2 (*a*).

As the aforementioned oversized amount "d" is input at step 106, the tool movable range is renewed on the basis of both this oversized amount "d" and the finish radius "D" at step 108. Thus a tool movable range (1–2) is newly renewed to a dimensional amount on which the additional grinding amount "d" is added to the finish radius "D", to provide a dimensional amount "D+d", as the boundary, and then step 110 follows. At this step, the automatic grinding operation is executed until the upper portion is ground above the oversized amount "d" plus the finish radius "D" which is set at the step 108. During the automatic grinding described herein, the automatic grinding is executed on the basis of a grinding cycle set beforehand in the NC program. As a result, the radius amount of the workpiece "W" coincides with a dimensional amount "D+d".

Therefore, even, in the event of a possible human error, namely machine operating failure, programming error and so forth, relating to movement of the grinding wheel during the automatic grinding, the tool movable range (1–2) prevents the grinding wheel from advancing into the dimensional amount "D+d".

When the automatic grinding operation at the step 110 is completed, the machining operation is halted temporarily. After performing the measurement of the radius of the workpiece at step 112, the operator judges how much the workpiece has to be machined to make it coincide with the finish radius "D". Thus, though the automatic grinding operation ought to have been completed so as to leave the oversized amount "d", as a matter of fact, the dimensional amount of the difference between a current measured radius of the ground workpiece and the finish radius "D" thereof does not necessarily coincide with the oversized amount "d" because of a thermal deformation or an axial bend of the workplace. To enhance the machining accuracy, the operator inputs the next grinding amount as the additional grinding amount "T" through the control panel 50. The additional grinding amount "T" is input by the operator through the keyboard at step 114. At step 116, the tool movable range is renewed on the basis of this additional grinding amount "T". Thus, at the step 116, the boundary, which signifies the tool movable range., is newly renewed to an dimensional amount "D+d−T" on which the additional grinding amount "T" is subtracted from the dimensional amount "D+d" because the tool movable range was previously set to the dimensional amount "D+d" as the boundary at the step 108. Thus, the upper portion of the dimensional amount "D+d−T" is defined as the tool movable range (1–3) as shown in FIG. 2(*b*).

At step 118, it is determined whether to perform the automatic grinding operation or the manual infeed operation to eliminate the additional grinding amount "T". Especially, in the case of performing the manual infeed operation which is the principal procedure of the present embodiment, it follows "Yes" to shift to step 120. On the other hand, in the case of performing the automatic grinding operation on the basis of a grinding cycle which is prepared beforehand, it follows "No" to shift to step 126. At this time, each grinding operation is performed as soon as the operator pushes the start button, and the additional grinding amount "T" which is input at the step 114 is renewed. As a result, in the case of performing a manual infeed operation at the step 120, the operator performs the grinding operation easily utilizing the tool movable range (1–3), which will be described later in more detail.

Upon completion of each grinding operation, either at step 120 or at step 126, the operation is halted temporarily. Then the measurement of radius of the workpiece is performed by the operator again at step 122. On the basis of this measurement, it is determined how much the workpiece has to be ground to coincide with the finish radius "D". As a result of this measurement, upon confirming that the radius of the workpiece "W" coincides with the finish radius "D" thereof, the operator pushes a finish button on the control panel. On the other hand, upon the operator judging that it is still necessary to grind the workpiece in order to obtain the finish radius "D", there may further be renewed the additional grinding amount "T" which was previously renewed at step 118. Now this additional grinding amount "T" is newly defined as "T'" in order to ease the explanation hereinafter.

At the step 124, it is determined whether the operator has pushed the finish button or not. If the finish button has been pushed, that is "Yes", the grinding operation is completed and the program routine shifts to step 128. If it is determined that the program is to grind other portions of the same workpiece "W" continuously such as in a series of the grinding operations, the generation returns to the step 100 in order to grind the next portion of the workplace. On the other hand, if the finish button has not been pushed, that is "No", the step 114 follows to grind again. In such manner, if the grinding operation is further continued at step 124, the program routine on and after step 114 is repeated. As the additional grinding amount "T" is renewed as "T'", this additional grinding amount "T'" is input at step 114. As a result, the tool movable range is renewed by further subtracting the additional grinding amount "T'" from the previous tool, movable range set at step 116. Thus, the previous tool movable range signifies the dimensional amount "D+d−T", whereas the renewed tool movable range (1–4) signifies a dimensional amount "D+d−T−T'". The additional grinding dimensional amount "T", "T'" and so forth are available for the establishment or the renewal of the tool movable range until the finish button on the control panel is pushed, so that this additional grinding amount "T'" is eliminated.

Further, though the additional grinding amount "T'", in which the additional grinding amount "T" is renewed at step 114, is further renewed on the basis of the previous tool movable range, it is allowable to renew the previous tool movable range as a new one on certain occasions. In such a case, there is renewed the additional grinding amount "T" in an expression of "D+d−T" in sequence. As described hereinafter, relating to setting the tool movable range according to the present invention, the tool movable range for restricting the tool movement is changed by renewing the additional grinding amount "T" in accordance with the operator's proceeding with the grinding operation.

The second embodiment will be described hereinafter according to an explanatory diagram of FIG. 3 and a flow chart of FIG. 5.

Figure 5:
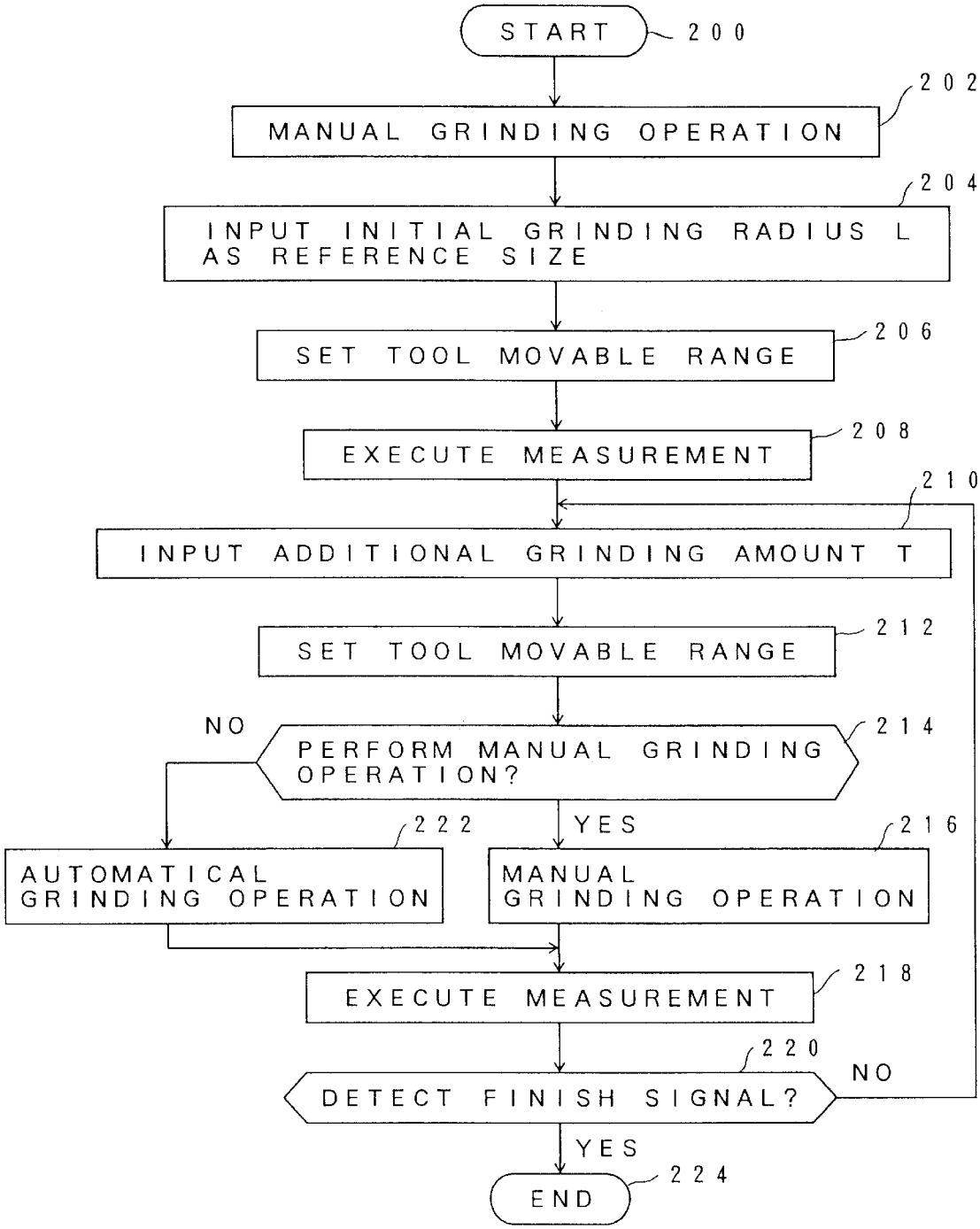
FIG. 5 is a flow chart of a routine showing another grinding operation executed by the central processing unit in the second embodiment of the present invention.

At step 200, a program routine is started relating to a grinding operation according to the second embodiment as shown in FIG. 5. The green face, which is an un-machined surface of the workpiece before an initial machining is done, is removed by performing a manual infeed operation at step 202, because it is impossible to measure the radius of the un-machined workpiece "W" accurately. The green face does not have a measurable surface roughness. At step 204, an initial grinding radius "L" is input as the reference size. Relating to inputting the initial grinding radius "L", there are two methods as described hereinafter. In the first method, as the grinding wheel is directly brought into contact with the workpiece "W" removed of the green face, a current position of the grinding wheel is stored in the memory device as the initial grinding radius "L" by the operator's pushing a button for inputting the initial grinding radius "L". In the second method, the operator performs a measurement of the radius of the workpiece and inputs the result of the measurement through the control panel 50 manually. As described In the first embodiment, this initial grinding radius "L" corresponds to a dimensional amount in which the oversized amount "d" is added to the finish radius "D".

At step 206, the tool movable range is established by defining the initial grinding radius "L" input at step 204 as the boundary. Therefore, the upper portion above the initial grinding radius "L" indicates the tool movable range (2–1) for the grinding wheel 15 as shown in FIG. 3 (*a*). On inputting this initial grinding radius "L", the operator performs the measurement of workpiece radius at step 208. On the basis of the result of this measurement, the operator judges how much the workpiece has to be machined to obtain the finish radius "D". The operator then inputs the next grinding amount as an additional grinding amount "T" through the keyboard on the control panel 50. The additional grinding amount "T" is input at step 210, and the tool movable range is newly renewed on the basis of this additional grinding amount "T" at step 212. Now, as a program routine on and after step 210 is the substantially the same as the program routine on and after the step 114 shown in FIG. 4, each different step only is described hereinafter. Because the tool movable range is established so as to define the initial grinding radius "L" as the boundary at the step 206, a tool movable range (2—2) is newly established by defining a dimensional amount "L−T", in which the additional grinding amount "T" subtracted from the initial grinding radius "L", as the boundary at step 212. At step 216 or step 222, the manual infeed operation or the automatical grinding operation is completed temporarily. Thereafter, the operator performs the measurement of the radius of the workpiece "W" at step 218. Furthermore, if the operator judges that it is necessary to further grind the workpiece, the additional grinding amount "T" is renewed to an additional grinding amount "T'". At this time, at the step 212 an additional grinding amount "T'" is further subtracted from the previous tool movable range. Thus the previous tool movable range signifies the dimensional amount "L−T", whereas a renewed tool movable range (2–3) signifies the dimensional amount "L−T−T'".

Figure 6:
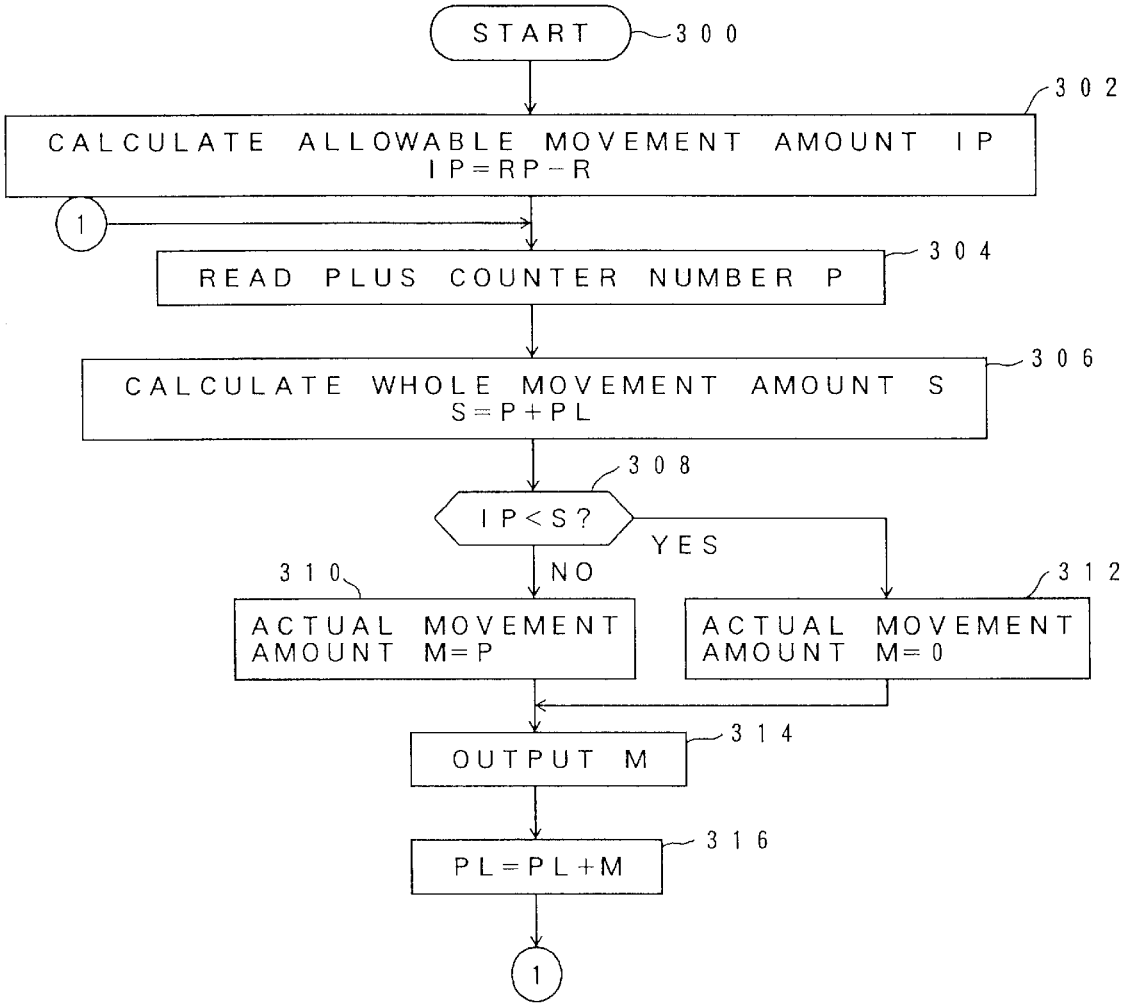
FIG. 6 is a flow chart of a subroutine to explain a manual infeed operation according to the first and second embodiments.

Next, the manual infeed operation relating to the step 120 or the step 216 will be described hereinafter according to the flow chart of FIG. 6.

At step 300, as soon as the manual infeed operation is performed, the program is executed to control the movement for wheel head 15 within the tool movable range. At step 302, an allowable movement amount "IP" is calculated. Thus, the allowable movement amount "IP" indicates a dimensional amount as the how much the wheal head 15 can move along the X axis from the current position. When the current position of wheel head 15 is defined as "R" and the tool movable range is defined as "RP", the allowable movement amount "IP" is calculated as "IP=RP−R". Herein, the tool movable range "RP" corresponds with the dimensional amount "D+d−T" in the case described at step 116, and similarly the dimensional amount "L−T" in the case described at step 216. At step 304, a pulse is issued according to a revolution amount of the handle 53 equipped on the control panel 50 by the operator, and a pulse counter number "P" is red at step 304. Thus, this program is executed to count the number of the pulse generated at a readable constant interval, and these numbers are input. At step 306, there is calculated a whole movement amount "S" in the period from performing manual infeed grinding to performing infeeding of the wheel head 15 according to the counter number "P". The whole movement amount "S" is calculated on the basis of the expression of "S=P+PL", in which the whole counter number is indicated as "PL" and similarly the current counter number is indicated as "P".

At step 308, there is judged whether the whole movement amount "S" is bigger than a tool allowable movement amount "IP" or not. If the whole movable amount "S" is bigger than or equal to the tool allowable movement amount "IP" (that is "Yes"), step 312 follows. Then, the actual movement amount "M=0" is made, because the tool movable amount is exceeded when the wheel head 15 is infed at only the counter number "P". If the whole movement amount "S" is smaller than or equal to the tool allowable movement amount "IP" (that is "No"), step 310 follows, in which the actual movement amount "M=P" is made, because the tool movable amount is not exceeded even if the wheel head 15 is infed at only the counter number "P". At step 310, the only actual movement amount "M" is output to the program which controls the infeed of the wheel head 15, so that the wheel head 15 moves by only the actual movement amount "M" obtained from the steps 310, 312. Thus, a movement rate command is calculated on the basis of the actual movement amount "M", and consecutively the wheel head 15 is moved. On the other hand, when the actual movement amount "M=0" is made at the step 312, the wheel head 15 is not infed. As a result, even if the operator rotates the handle 53 for infeeding the wheel head 15 and further the movement amount of wheel head 15 in excess of the tool movable range, the wheel head 15 does not travel. At step 316, the renewal of the whole counter number "PL" relating to the pulse is executed. Thus, the expression of "PL=PL+M" is executed. In this manner, the count number on which the wheel head 15 actually moves is obtained. Until this step 316 is completed, the program routine on and after step 304 is repeated again. Therefore, even if the operator rotates the handle 53 during the grinding operation at will, the wheel head does not move beyond the tool movable range.

In the above described manual grinding operation, although the process in which the movement for the wheel head 15 is described relating to the manual infeed operation in which the operator rotates the handle 53 for infeeding the grinding wheel, the present invention is also applicable to automatic grinding operations.

Figure 7:
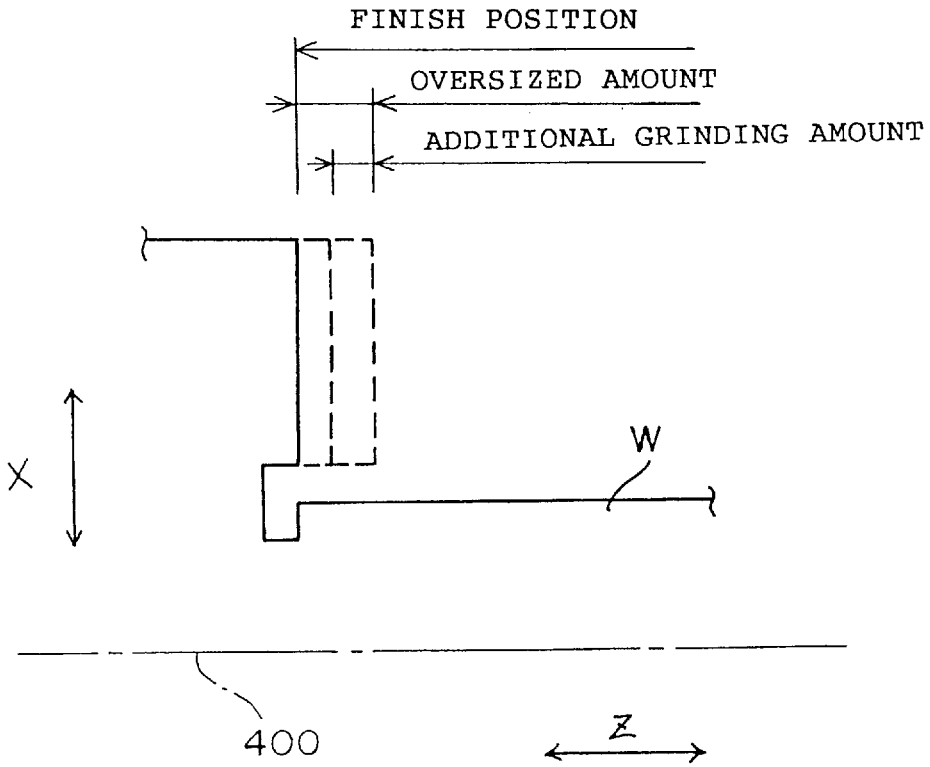
FIG. 7 is an explanatory diagram showing a machining operation to explain the third embodiment according to the present invention.

In addition, in the present embodiments described hereinbefore, the dimensions are set on the basis of the radius direction of the workpiece "W", namely the X axis direction so that the movement of the wheel head 15 is executed along the X axis during the grinding operation. Therefore, as the case of machining toward an end face of the workpiece as shown in FIG. 7, the Z axis may be set as dimensional basis. Moreover, this invention may be applied to other machine tools such as a turning machine.

Obviously, numerous modifications and variations of the present invention are possible in light of the above teachings. It is therefore to be understood that within the scope of the appended claims, the present invention may be practiced otherwise than as specifically described herein.

What is claimed is:

1. A machining method for machining a workpiece by manual control comprising the steps of:

(a) setting an oversize amount which is an amount of machining remaining to be performed on the workpiece to provide a strict tolerance;

(b) tentatively setting a movable range of a tool based upon said oversize amount and a desired size of the workpiece;

(c) moving the tool in a direction relative to the workpiece; and (d) halting movement of the tool in the event that a position of the tool exceeds said movable range.

2. A machining method for machining a workpiece by manual control according to claim 1, further comprising the steps of:

(e) measuring a size of the workpiece to obtain a measured size of the workpiece;

(f) renewing the previous movable range to provide a renewed movable range based upon the desired size of the workpiece and said measured size, to make the tolerance stricter than the previous movable range;

(g) moving the tool in said direction relative to the workpiece again; and (h) halting movement of the tool in the event that the position of the tool exceeds the renewed movable range.

3. A machining method for machining a workpiece by manual control according to claim 2, wherein the previous movable range is automatically renewed to provide the renewed movable range by inputting a coordinate value of one of the workpiece and a machining apparatus.

4. A machining method for machining a workpiece by manual control as recited in claim 2, further including repeating steps of measuring the size of the workpiece, renewing the previous movable range to provide a renewed movable range, moving the tool in said direction relative to the workpiece, and halting movement of the tool in the event the position of the tool exceeds the renewed movable range, and wherein said steps are repeated until the size measured in the measuring step coincides with the desired size.

5. A machining method is recited in claim 2, wherein movement of said tool in said direction is controlled manually utilizing a handle, and further wherein movement of said tool is prevented despite operator attempts at moving said handle when said position of said tool exceeds said renewed movable range.

6. A machining method as recited in claim 1, wherein movement of said tool in said direction is controlled manually utilizing a handle, and further wherein movement of said tool is prevented despite operator attempts at moving said handle when said position of said tool exceeds said movable range.

7. A machining method as recited in claim 2, wherein in step (f) an operator inputs an additional grinding amount value to establish said renewed movable range.

* * * * *